US011171408B2

(12) United States Patent
Lin et al.

(10) Patent No.: US 11,171,408 B2
(45) Date of Patent: Nov. 9, 2021

(54) COMMUNICATION DEVICE

(71) Applicant: HTC Corporation, Taoyuan (TW)

(72) Inventors: Cheng-Hung Lin, Taoyuan (TW); Chia-Te Chien, Taoyuan (TW); Kang-Ling Li, Taoyuan (TW); Chun-Hsien Lee, Taoyuan (TW); Yu-Chieh Chiu, Taoyuan (TW); Ching-Chih Su, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 16/860,816

(22) Filed: Apr. 28, 2020

(65) Prior Publication Data

US 2020/0373648 A1 Nov. 26, 2020

Related U.S. Application Data

(60) Provisional application No. 62/851,675, filed on May 23, 2019.

(51) Int. Cl.

| | |
|---|---|
| ***H01Q 1/22*** | (2006.01) |
| ***H01Q 5/30*** | (2015.01) |
| ***H01Q 1/24*** | (2006.01) |
| ***H01Q 5/307*** | (2015.01) |

(52) U.S. Cl.
CPC ..... *H01Q 1/243* (2013.01); *H01Q 5/307* (2015.01)

(58) Field of Classification Search
CPC ..... H01Q 1/22; H01Q 1/24; H01Q 1/243; H01Q 3/00; H01Q 3/26; H01Q 5/30; H01Q 5/307; H01Q 21/00; H01Q 1/241
See application file for complete search history.

(56) References Cited

U.S. PATENT DOCUMENTS

| | | | | |
|---|---|---|---|---|
| 10,200,092 | B1 * | 2/2019 | Irci | H04B 5/02 |
| 10,305,171 | B1 * | 5/2019 | Navarro | H01Q 1/243 |
| 10,847,901 | B1 * | 11/2020 | Ayala Vazquez | H01Q 1/245 |
| 11,043,734 | B2 * | 6/2021 | Ha | H01Q 5/35 |
| 2007/0176829 | A1 * | 8/2007 | Liu | H01Q 9/0421 343/702 |
| 2013/0050056 | A1 * | 2/2013 | Lee | H01Q 9/0407 343/893 |
| 2013/0222613 | A1 * | 8/2013 | Yehezkely | G06F 3/005 348/207.1 |
| 2016/0087348 | A1 | 3/2016 | Ko et al. | |
| 2016/0308563 | A1 * | 10/2016 | Ouyang | H01Q 21/0025 |

(Continued)

FOREIGN PATENT DOCUMENTS

| | | | | |
|---|---|---|---|---|
| CN | 206864641 U * | 1/2018 | | H01Q 1/00 |
| EP | 3 422 140 A1 | 1/2019 | | |
| WO | WO-2019018115 A1 * | 1/2019 | | H01Q 1/44 |

OTHER PUBLICATIONS

Extended European Search Report for European Application No. 20175987.5, dated Oct. 28, 2020.

*Primary Examiner* — Blane J Jackson
(74) *Attorney, Agent, or Firm* — Birch, Stewart, Kolasch & Birch, LLP

(57) ABSTRACT

A communication device includes one or more mmWave (Millimeter Wave) antenna elements and a display device. The display device has a partition line. A first region is formed above the partition line, and a second region is formed below the partition line. The mmWave antenna elements are disposed in the first region. There is no mmWave antenna element disposed in the second region.

12 Claims, 7 Drawing Sheets

(56) References Cited

U.S. PATENT DOCUMENTS

| | | | | |
|---|---|---|---|---|
| 2017/0117929 | A1* | 4/2017 | Nghiem | H04M 1/0279 |
| 2017/0309991 | A1* | 10/2017 | Noori | H01Q 1/241 |
| 2018/0090816 | A1* | 3/2018 | Mow | H01Q 1/22 |
| 2018/0351235 | A1* | 12/2018 | Wang | H01Q 5/378 |
| 2019/0006735 | A1* | 1/2019 | Lee | H01Q 9/42 |
| 2019/0027808 | A1* | 1/2019 | Mow | H04R 1/025 |
| 2019/0229413 | A1* | 7/2019 | Jong | H01Q 21/062 |
| 2019/0260112 | A1* | 8/2019 | Azad | H01Q 21/064 |
| 2019/0267710 | A1* | 8/2019 | Jenwatanavet | H01Q 9/0407 |
| 2019/0379119 | A1* | 12/2019 | He | H01Q 21/28 |
| 2019/0393586 | A1* | 12/2019 | Ayala Vazquez | H01Q 21/28 |
| 2019/0393918 | A1* | 12/2019 | Han | G06T 7/521 |
| 2020/0021025 | A1* | 1/2020 | Gomez Angulo | H04B 1/0458 |
| 2020/0036083 | A1* | 1/2020 | Kim | H01Q 1/38 |
| 2020/0144713 | A1* | 5/2020 | Jung | H04B 7/0617 |
| 2021/0075091 | A1* | 3/2021 | Lee | H01Q 1/245 |

* cited by examiner

COMMUNICATION DEVICE

CROSS REFERENCE TO RELATED APPLICATIONS

This application claims the benefit of U.S. Provisional Application No. 62/851,675, filed on May 23, 2019, the entirety of which is incorporated by reference herein.

BACKGROUND OF THE INVENTION

Field of the Invention

The disclosure generally relates to a communication device, and more particularly, to a communication device with a spatial diversity function.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements that allow mobile devices in a room to connect to the Internet at high speeds. However, since indoor environments have serious problems with signal reflection and multipath fading, wireless access points should process signals from a variety of transmission directions simultaneously. Accordingly, it has become a critical challenge for current designers to design a high-isolation communication device with multiple radiation directions in the limited space of a wireless access point.

BRIEF SUMMARY OF THE INVENTION

In a preferred embodiment, the invention proposes a communication device that includes one or more mmWave (Millimeter Wave) antenna elements and a display device. The display device has a partition line. A first region is formed above the partition line, and a second region is formed below the partition line. The mmWave antenna elements are disposed in the first region. There is no mmWave antenna element disposed in the second region.

In some embodiments, the communication device further includes a housing. The display device is embedded in the housing.

In some embodiments, the housing is made of a nonconductive material.

In some embodiments, the mmWave antenna elements adhere to the housing.

In some embodiments, the first region is adjacent to an upper-half portion of the housing.

In some embodiments, the first region has a first vertical projection on a front surface of the housing, and the first vertical projection substantially has a straight-line shape.

In some embodiments, the first region has a second vertical projection on a back surface of the housing, and the second vertical projection substantially has a T-shape.

In some embodiments, the second region is adjacent to a lower-half portion of the housing.

In some embodiments, the second region has a third vertical projection on a front surface of the housing, and the third vertical projection substantially has a U-shape.

In some embodiments, the second region has a fourth vertical projection on a back surface of the housing, and the fourth vertical projection substantially has a U-shape.

In some embodiments, the total number of mmWave antenna elements is equal to 3.

In some embodiments, the mmWave antenna elements cover a WiGig band and/or an FR2 (Frequency Range 2) band of 5G NR (New Radio).

In some embodiments, the mmWave antenna elements include a first mmWave antenna element for generating front radiation, a second mmWave antenna element for generating back radiation, and a third mmWave antenna element for generating upper radiation.

In some embodiments, each of the first mmWave antenna element and the third mmWave antenna element has a fifth vertical projection on a front surface of the housing, and the fifth vertical projection does not overlap the display device.

In some embodiments, the second mmWave antenna element has a sixth vertical projection on a front surface of the housing, and the sixth vertical projection at least partially overlaps the display device.

In some embodiments, the communication device further includes one or more microwave antenna elements disposed in the first region, the second region, or both.

In some embodiments, the microwave antenna elements cover a Wi-Fi band, an LTE (Long Term Evolution) band, and/or an FR1 (Frequency Range 1) band of 5G NR.

In some embodiments, the total number of microwave antenna elements is equal to 4, and the microwave antenna elements are adjacent to the respective corners of the housing.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
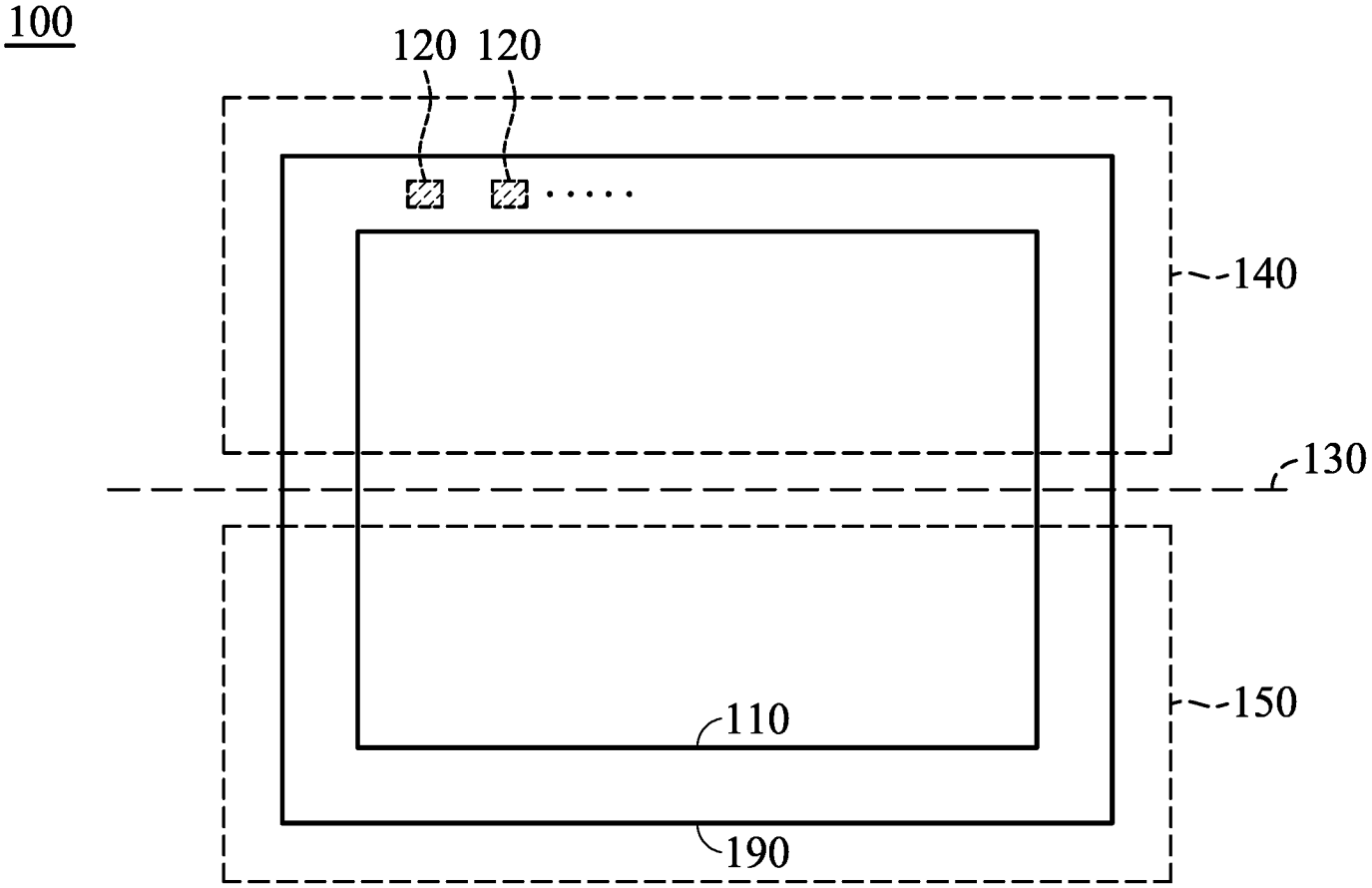
FIG. 1 is a diagram of a communication device according to an embodiment of the invention.

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the subject matter provided. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a diagram of a communication device 100 according to an embodiment of the invention. For example, the communication device 100 may be implemented with a wireless access point, but it is not limited thereto. As shown in FIG. 1, the communication device 100 at least includes a display device 110 and one or more mmWave (Millimeter Wave) antenna elements 120. It should be understood that the communication device 100 may further include other components, such as a speaker, a touch control module, and/or a power supply module, although they are not displayed in FIG. 1.

The shapes and types of the aforementioned mmWave antenna elements 120 are not limited in the invention. For example, any of the mmWave antenna elements 120 may be a monopole antenna, a dipole antenna, a loop antenna, a patch antenna, a helical antenna, a PIFA (Planar Inverted F Antenna), or a chip antenna. These mmWave antenna elements 120 can cover the same operation frequency band, for example, from 20 GHz to 90 GHz.

In some embodiments, the communication device 100 further includes a housing 190, which is made of a nonconductive material. The display device 110 may be embedded in the center of the housing 190. The mmWave antenna elements 120 may all be adhered onto the housing 190. For example, the mmWave antenna elements 120 may all be disposed inside the housing 190. Alternatively, the mmWave antenna elements 120 may all be disposed outside the housing 190. The two designs can provide similar performance.

To easily understand the technical solution of the invention, it is assumed that the display device 110 has a virtual partition line 130 thereon. A first region 140 is substantially formed above the partition line 130, and a second region 150 is substantially formed below the partition line 130. The second region 150 is completely separate from the first region 140. The mmWave antenna elements 120 are disposed in the first region 140. There is no mmWave antenna element disposed in the second region 150. It should be understood that the so-called "region" means the space around the housing 190 of the communication device 100, which may be internal space of the housing 190 or external space of the housing 190. If technically necessary, the partition line 130 may be replaced with a partition plane. In some embodiments, the partition line 130 may be substantially a straight line if it is positioned at the center of the display device 110. In alternative embodiments, the partition line 130 may be a meandering line if it extends along a border outline of the display device 110.

In some embodiments, the first region 140 is adjacent to an upper-half portion of the housing 190, and the second region 150 is adjacent to a lower-half portion of the housing 190. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0). For example, if the housing 190 has a hollow internal space, the first region 140 may correspond to the upper-half portion of the hollow internal space, and the second region 150 may correspond to the lower-half portion of the hollow internal space, but they are not limited thereto.

Figure 2:
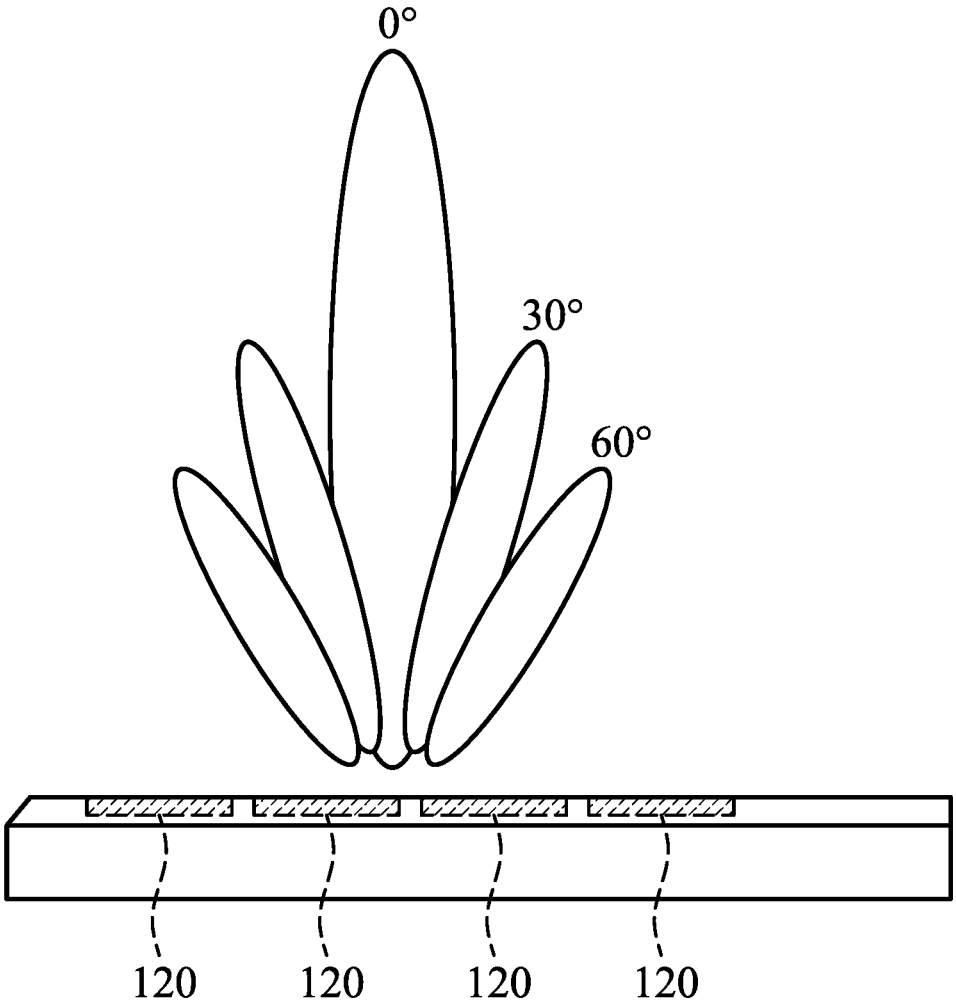
FIG. 2 is a diagram of a radiation pattern of mmWave antenna elements according to an embodiment of the invention.

FIG. 2 is a diagram of a radiation pattern of the mmWave antenna elements 120 according to an embodiment of the invention. As shown in FIG. 2, each mmWave antenna element 120 has characteristics of high directivity and high attenuation rate. With the design of the invention, the mmWave antenna elements 120 may be only distributed in the first region 140 of the communication device 100, and the second region 150 of the communication device 100 can accommodate other antenna elements. Thus, these mmWave antenna elements 120 do not tend to interfere with other antenna elements. Such a design of spatial diversity can significantly improve the whole communication quality of the communication device 100. Also, the maximum energy of the transmitter source of each antenna element is distributed at a respective position. It can prevent energy sources from overlapping each other, and reduce the corresponding SAR (Specific Absorption Rate).

Figure 3:
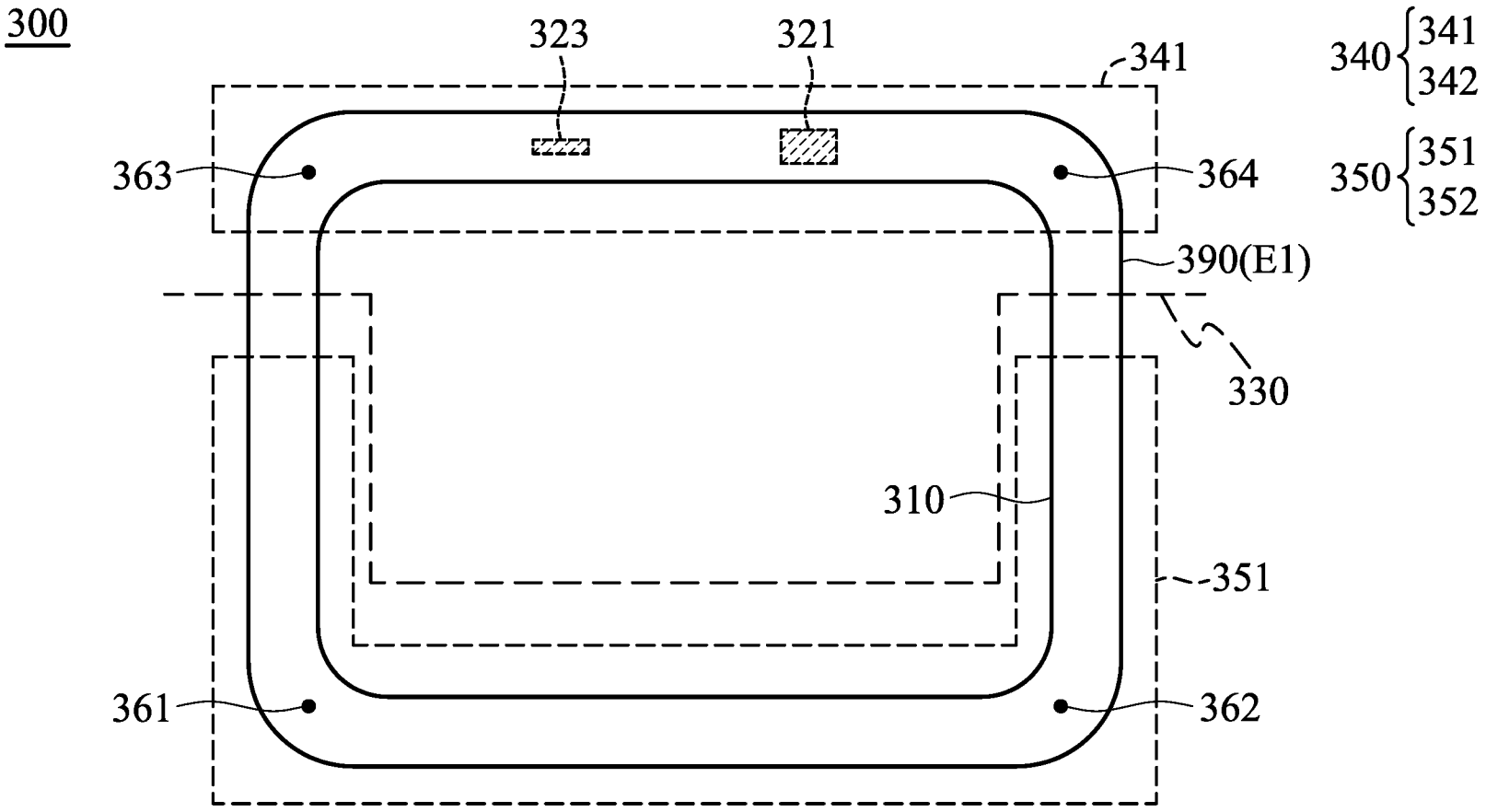
FIG. 3 is a front view of a communication device according to an embodiment of the invention.
Figure 4:
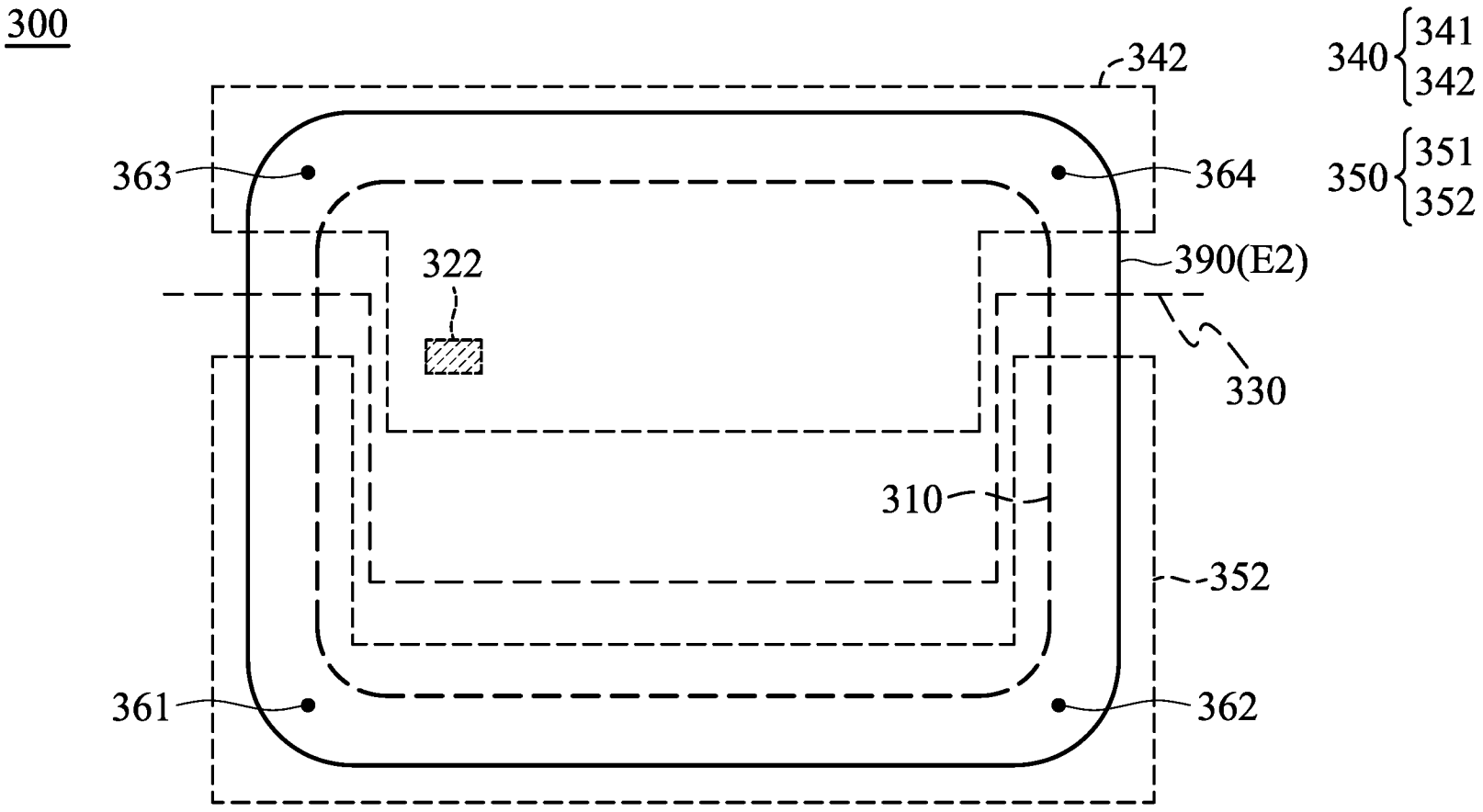
FIG. 4 is a back view of the communication device according to an embodiment of the invention.
Figure 5:
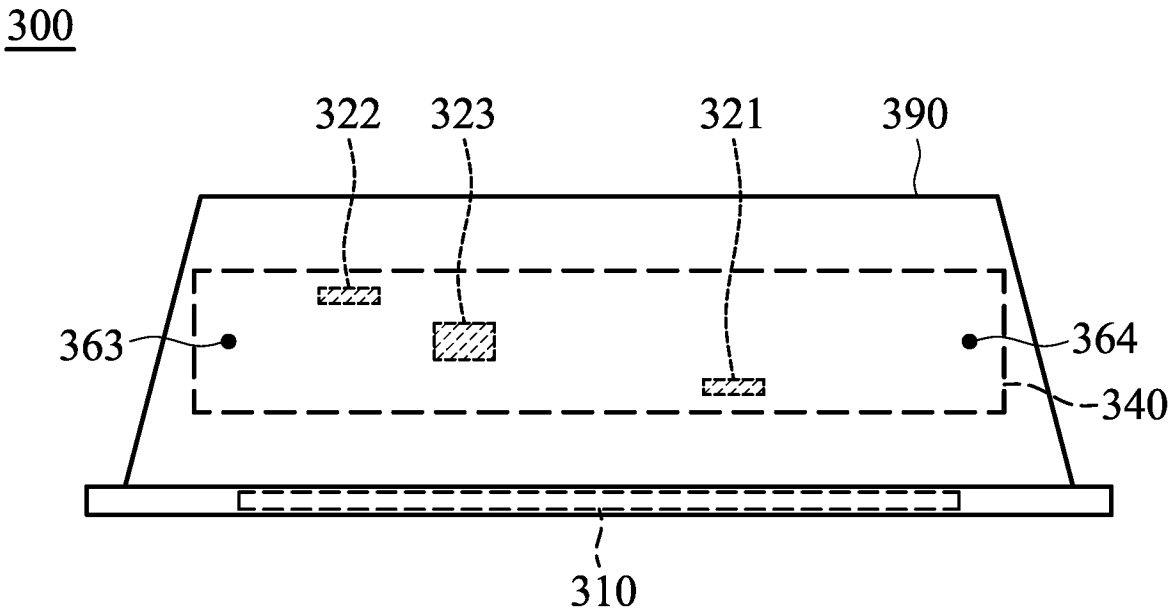
FIG. 5 is a top view of the communication device according to an embodiment of the invention.

FIG. 3 is a front view of a communication device 300 according to an embodiment of the invention. FIG. 4 is a back view of the communication device 300 according to an embodiment of the invention. FIG. 5 is a top view of the communication device 300 according to an embodiment of the invention. Please refer to FIGS. 3-5 together. As shown in FIGS. 3-5, the communication device 300 includes a display device 310, a first mmWave antenna element 321, a second mmWave antenna element 322, and a third mmWave antenna element 323. That is, in the embodiments of FIGS. 3-5, the total number of mmWave antenna elements of the communication device 300 is exactly equal to 3; however, in other embodiments, the total number of mmWave antenna elements is adjustable according to different requirements.

The shapes and types of the first mmWave antenna element 321, the second mmWave antenna element 322, and the third mmWave antenna element 323 are not limited in the invention. For example, any of the first mmWave antenna element 321, the second mmWave antenna element 322, and the third mmWave antenna element 323 may be a monopole antenna, a dipole antenna, a loop antenna, a patch antenna, a helical antenna, a PIFA, or a chip antenna. In addition, the first mmWave antenna element 321, the second mmWave antenna element 322, and the third mmWave antenna element 323 can cover the same operation frequency band. For example, the first mmWave antenna element 321, the second mmWave antenna element 322, and the third mmWave antenna element 323 can cover a WiGig band and/or an FR2 (Frequency Range 2) band of 5G NR (New Radio), which may be from 20 GHz to 90 GHz.

In some embodiments, the communication device 300 further includes a housing 390, which is made of a nonconductive material. The housing 390 has a front surface E1 and a back surface E2, which are opposite to each other. The display device 310 may be embedded in the center of the housing 390. The first mmWave antenna element 321, the second mmWave antenna element 322, and the third mmWave antenna element 323 may all be adhered onto the housing 390. For example, the first mmWave antenna element 321, the second mmWave antenna element 322, and the third mmWave antenna element 323 may all be disposed inside the housing 390. Alternatively, the first mmWave antenna element 321, the second mmWave antenna element 322, and the third mmWave antenna element 323 may all be disposed outside the housing 390. The two designs can provide similar performance.

A virtual partition line 330 passing through the display device 310 completely separates a first region 340 from a second region 350. The first mmWave antenna element 321, the second mmWave antenna element 322, and the third mmWave antenna element 323 are all disposed in the first region 340. There is no mmWave antenna element disposed in the second region 350. If technically necessary, the partition line 330 may be replaced with a partition plane. As mentioned above, in some embodiments, the partition line 330 is substantially a U-shaped bending line. In alternative embodiments, the partition line 330 is substantially a straight line.

In some embodiments, the first region 340 is adjacent to an upper-half portion of the housing 390, and the second region 350 is adjacent to a lower-half portion of the housing 390 and is around surrounding sides of the housing 390. For example, if the housing 390 has a hollow internal space, the first region 340 may correspond to the upper-half portion of the hollow internal space, and the second region 350 may correspond to the lower-half portion of the hollow internal space, but they are not limited thereto.

In some embodiments, the first region 340 has a first vertical projection 341 on the front surface E1 of the housing 390, and the first vertical projection 341 substantially has a straight-line shape. The first region 340 has a second vertical projection 342 on the back surface E2 of the housing 390, and the second vertical projection 342 substantially has a T-shape. Since the display device 310 occupies a portion of the front surface E1 of the housing 390, the area of the second vertical projection 342 may be slightly larger than the area of the first vertical projection 341. Specifically, both the first mmWave antenna element 321 and the third mmWave antenna element 323 may at least partially overlap the first vertical projection 341 of the first region 340, and the second mmWave antenna element 322 may at least partially overlap the second vertical projection 342 of the first region 340. In alternative embodiments, adjustments are made such that the second vertical projection 342 of the first region 340 has another straight-line shape, which may be substantially the same as the first vertical projection 341 of the first region 340.

In some embodiments, the second region 350 has a third vertical projection 351 on the front surface E1 of the housing 390, and the third vertical projection 351 substantially has a U-shape. The second region 350 has a fourth vertical projection 352 on the back surface E2 of the housing 390, and the fourth vertical projection 352 substantially has another U-shape. That is, the display device 310 may be substantially surrounded by the first vertical projection 341 of the first region 340 and the third vertical projection 351 of the second region 350.

In some embodiments, each of the first mmWave antenna element 321 and the third mmWave antenna element 323 has a fifth vertical projection on the front surface E1 of the housing 390, and the fifth vertical projection does not overlap the display device 310 at all. In some embodiments, the second mmWave antenna element 322 has a sixth vertical projection on the front surface E1 of the housing 390, and the sixth vertical projection at least partially overlaps the display device 310.

In some embodiments, when the communication device 300 needs to communicate with another device, it may initially search for the orientation of the corresponding device, and then automatically select one of the first mmWave antenna element 321, the second mmWave antenna element 322, and the third mmWave antenna element 323. The selected one may have the best communication quality for signal transmission or signal reception.

In some embodiments, the communication device 300 further includes one or more microwave antenna elements 361, 362, 363 and 364, which may be disposed in the first region 340, the second region 350, or both. These microwave antenna elements 361, 362, 363 and 364 can cover a Wi-Fi band, an LTE (Long Term Evolution) band, and/or an FR1 (Frequency Range 1) band of 5G NR (New Radio), which may be from 0.3 GHz to 10 GHz. For example, the total number of microwave antenna elements 361, 362, 363 and 364 may be equal to 4, and the microwave antenna elements 361, 362, 363 and 364 may be adjacent to the four respective corners of the housing 360. However, in other embodiments, the total number of microwave antenna elements 361, 362, 363 and 364 is adjustable according to different requirements. In some embodiments, some microwave antenna elements 361 and 362 are disposed in the second region 350, and the other microwave antenna elements 363 and 364 are disposed in the first region 340.

Figure 6:
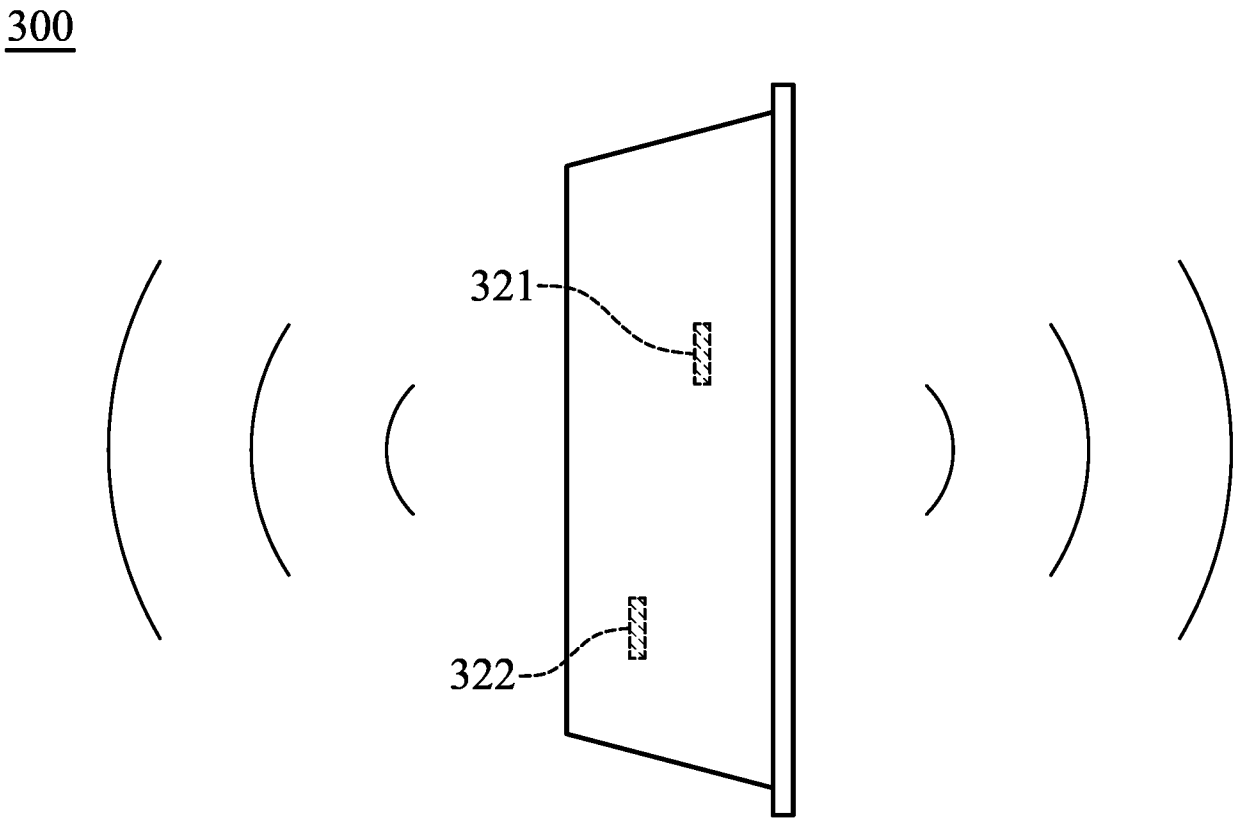
FIG. 6 is a top view of radiation patterns of a first mmWave antenna element, a second mmWave antenna element, and a third mmWave antenna element according to an embodiment of the invention.
Figure 7:
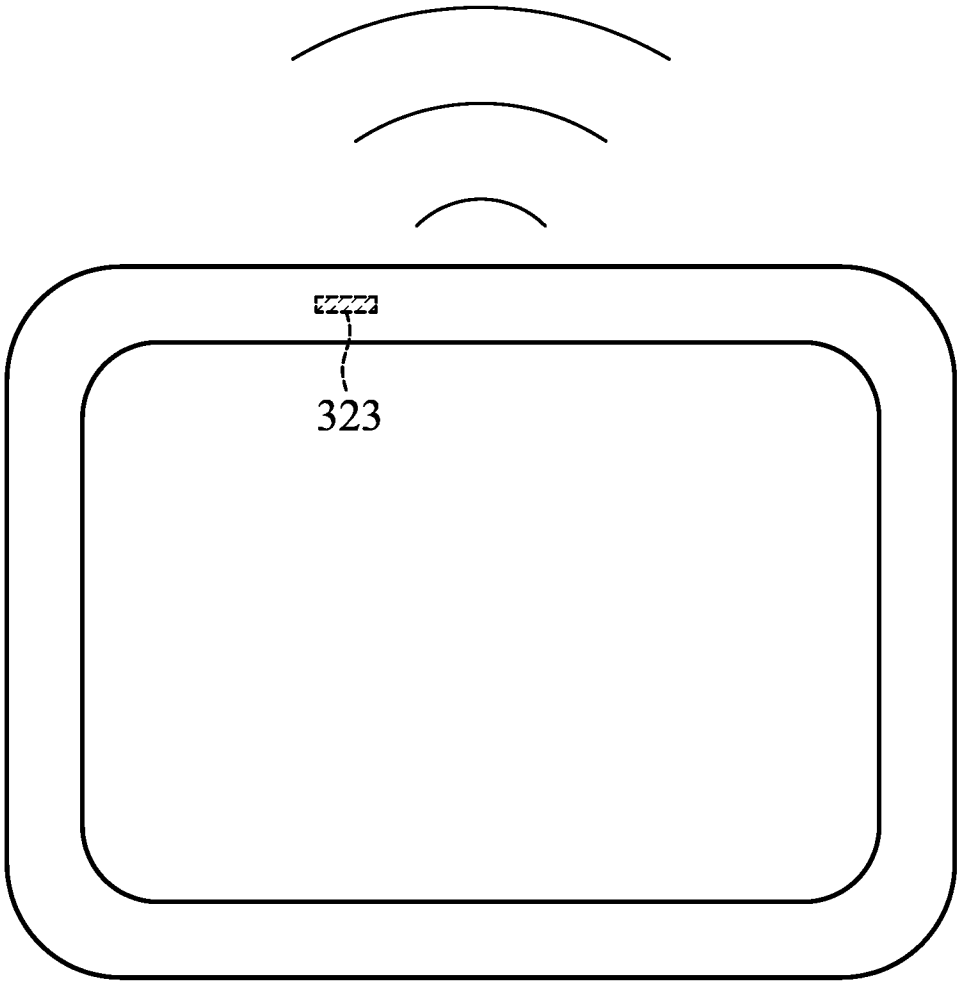
FIG. 7 is a front view of radiation patterns of a first mmWave antenna element, a second mmWave antenna element, and a third mmWave antenna element according to an embodiment of the invention.

FIG. 6 is a top view of radiation patterns of the first mmWave antenna element 321, the second mmWave antenna element 322, and the third mmWave antenna element 323 according to an embodiment of the invention. FIG. 7 is a front view of the radiation patterns of the first mmWave antenna element 321, the second mmWave antenna element 322, and the third mmWave antenna element 323 according to an embodiment of the invention. According to the measurements of FIGS. 6 and 7, the first mmWave antenna element 321 is arranged for generating front radiation, the second mmWave antenna element 322 is arranged for generating back radiation, and the third mmWave antenna element 323 is arranged for generating upper radiation. With such a design, the first mmWave antenna element 321, the second mmWave antenna element 322, and the third mmWave antenna element 323 using the beamforming technology can cover the signal transmissions in the front, back and top of the communication device 300. The other microwave antenna elements 361, 362, 363 and 364 can provide an almost omnidirectional radiation pattern. According to practical measurements, such a diverse arrangement can avoid too concentrated energy distribution of radiation sources, and reduce the SAR (Specific Absorption Rate) relative to the communication device 300.

The invention proposed a novel communication device. In comparison to the conventional design, the invention has at least the following advantages of: (1) supporting mmWave communication, (2) reducing the SAR, (3) generating an almost omnidirectional radiation pattern, (4) increasing isolation between antenna elements, (5) having a simple structure for mass production, and (6) reducing the whole manufacturing cost. Therefore, the invention is suitable for application in a variety of wireless access points.

Note that the above element sizes, element shapes, and frequency ranges are not limitations of the invention. An antenna designer can fine-tune these settings or values according to different requirements. It should be understood that the communication device of the invention is not limited to the configurations of FIGS. 1-7. The invention may include any one or more features of any one or more embodiments of FIGS. 1-7. In other words, not all of the features displayed in the figures should be implemented in the communication device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a plurality of mmWave (Millimeter Wave) antenna elements;

a display device, having a partition line, wherein a first region is formed above the partition line, and a second region is formed below the partition line;

a housing, wherein the display device is embedded in the housing; and four microwave antenna elements, disposed in the first region and the second region;

wherein the mmWave antenna elements are disposed in the first region, and there is no mmWave antenna element disposed in the second region;

wherein the microwave antenna elements are adjacent to respective corners of the housing;

wherein the first region has a first vertical projection on a front surface of the housing, and the first vertical projection substantially has a straight-line shape;

wherein the first region has a second vertical projection on a back surface of the housing, and the second vertical projection substantially has a T-shape; and wherein two of the mmWave antenna elements at least partially overlap the first vertical projection, and another one of the mmWave antenna elements at least partially overlaps the second vertical projection.

2. The communication device as claimed in claim 1, wherein the housing is made of a nonconductive material.

3. The communication device as claimed in claim 1, wherein the mmWave antenna elements adhere to the housing.

4. The communication device as claimed in claim 1, wherein the first region is adjacent to an upper-half portion of the housing.

5. The communication device as claimed in claim 1, wherein the second region is adjacent to a lower-half portion of the housing.

6. The communication device as claimed in claim 1, wherein the second region has a third vertical projection on a front surface of the housing, and the third vertical projection substantially has a U-shape.

7. The communication device as claimed in claim 1, wherein the second region has a fourth vertical projection on a back surface of the housing, and the fourth vertical projection substantially has a U-shape.

8. The communication device as claimed in claim 1, the mmWave antenna elements cover a WiGig band and/or an FR2 (Frequency Range 2) band of 5G NR (New Radio).

9. The communication device as claimed in claim 1, wherein the mmWave antenna elements comprise a first mmWave antenna element for generating front radiation, a second mmWave antenna element for generating back radiation, and a third mmWave antenna element for generating upper radiation.

10. The communication device as claimed in claim 9, wherein each of the first mmWave antenna element and the third mmWave antenna element has a fifth vertical projection on a front surface of the housing, and the fifth vertical projection does not overlap the display device.

11. The communication device as claimed in claim 9, wherein the second mmWave antenna element has a sixth vertical projection on a front surface of the housing, and the sixth vertical projection at least partially overlaps the display device.

12. The communication device as claimed in claim 1, wherein the microwave antenna elements cover a Wi-Fi band, an LTE (Long Term Evolution) band, and/or an FR1 (Frequency Range 1) band of 5G NR (New Radio).

* * * * *